US007422102B1

(12) United States Patent
Lam et al.

(10) Patent No.: US 7,422,102 B1
(45) Date of Patent: Sep. 9, 2008

(54) CONTAINER FOR AMMUNITION

(75) Inventors: Yuen H. Lam, Morris Plains, NJ (US); William Paulo, Parsippany, NJ (US); John A. Sliker, Andover, NJ (US); Timothy Woo, Flushing, NY (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 502 days.

(21) Appl. No.: 11/161,478

(22) Filed: Sep. 2, 2005

(51) Int. Cl.
*F42B 39/00* (2006.01)

(52) U.S. Cl. ..... 206/3; 206/317; 206/488

(58) Field of Classification Search ..... 206/3, 206/317, 486, 488; 102/293; 220/378; 224/196, 224/199, 223, 239, 600; 217/18; 42/87
See application file for complete search history.

(56) References Cited

U.S. PATENT DOCUMENTS 3,508,368 A * 4/1970 Keys et al. ..... 52/394
4,733,773 A * 3/1988 LaBianca et al. ..... 206/3
4,762,222 A * 8/1988 Martin ..... 206/3
5,670,274 A * 9/1997 Forrer ..... 429/187
5,779,031 A * 7/1998 Moraine et al. ..... 206/3
6,622,862 B1 * 9/2003 Corrado ..... 206/363
7,121,401 B1 * 10/2006 Sinha et al. ..... 206/3
2004/0084330 A1 * 5/2004 Borngen et al. ..... 206/3

* cited by examiner

*Primary Examiner*—J. Gregory Pickett
*Assistant Examiner*—Ernesto A Grano
(74) *Attorney, Agent, or Firm*—John F. Moran

(57) ABSTRACT

A container for an ammunition cartridge having a conical forward portion includes a generally cylindrical cap having a closed end and an open end; a generally cylindrical main body having a closed end, an open end and a wall, a thickness of the wall at the open end decreasing from a larger thickness to a smaller thickness to form a taper on an exterior surface of the wall; a latch assembly disposed in part on the cap and in part on the main body to lock the cap and the main body in position; a first gasket disposed in the cap; a second gasket disposed around the taper of the main body; a cartridge support disposed inside the main body; a pair of bosses disposed on the main body and axially separated; and a strap connecting the bosses and comprising a middle portion and two end portions, whereby when a load is applied to the middle portion the end portions are forced against the bosses.

4 Claims, 13 Drawing Sheets

CONTAINER FOR AMMUNITION

STATEMENT OF GOVERNMENT INTEREST

The inventions described herein may be manufactured, used and licensed by or for the U.S. Government for U.S. Government purposes.

BACKGROUND OF THE INVENTION

The invention relates to the field of military ordnance. In particular, it relates to large caliber ammunition fired from weapons in the arsenal of the United States Army, and more specifically to ammunition containers that protect the rounds fired from these weapons. While specifically developed for mortar ammunition, the invention is readily adapted to tank ammunition, grenades, and other ammunition families.

Ordnance used on the modern battlefield and in training exercises by the United States Army must be protected from the effects of vibration, shock and exposure to the elements. Exemplary cases are relatively lightweight, mobile weapons such as the Army's 60 mm, 81 mm and 120 mm mortars. The inherent portability, flexibility and ubiquity of these weapons dictate that they and the ammunition they fire can and will be exposed to a very wide range of non-ideal conditions.

These weapons and their ammunition are required to perform in conditions that include extreme heat and cold, as well as wet and dusty environs. Ammunition for these mortars is expected to survive high g-loadings such as those that might be experienced when being transported by tracked or wheeled vehicles, carried by soldiers or even delivered by fixed- or rotary-wing aircraft or by parachute.

Recent emphasis on rapid deployment and the requirement for heretofore unimaginable mobility and unprecedented firepower, as exemplified by the US Army's new Lightweight Brigade Combat Team (BCT), gives all new importance to minimizing the weight and volume associated with packing materials while maintaining the protection required by these highly explosive rounds. In addition, cost and environmental concerns can no longer be ignored and, therefore, must be addressed in an effective manner. These requirements place added restrictions on construction materials and techniques and require that the containers be re-usable and/or recyclable.

U.S. Pat. No. 6,772,877 issued on Aug. 10, 2004 and is hereby expressly incorporated by reference. The '877 patent discloses a MONOPAQ™ container. While the MONOPAQ™ container of the '877 patent has functioned better than its predecessor, some of its features may be improved. First, because the MONOPAQ™ container and ammunition cartridge stored therein are handled by one person, weight is an important factor. Any weight reduction is helpful. Second, an ammunition container must be sealed in a manner to provide full environmental protection to ammunition packaged for 20 years of indoor storage and 2 years of outdoor storage. Such a seal must withstand at least a 3 psi differential. The known MONOPAQ™ container has dimensional restraints that make it difficult to obtain a satisfactory seal. Third, the carrying handle of the MONOPAQ™ container needs to be lightweight, sturdy and easily manufactured and assembled.

SUMMARY OF THE INVENTION

It is an object of the invention to provide a MONOPAQ™ container with reduced weight, in particular with a reduced weight cartridge support.

It is another object of the invention is to provide a MONOPAQ™ container with a seal that will provide full environmental protection to ammunition packaged for 20 years of indoor storage and 2 years of outdoor storage and will retain at least a 3 psi seal.

Yet another object of the invention is to provide a MONOPAQ™ container with a collapsible carrying handle that is lightweight, sturdy and easily manufactured and assembled.

A first feature of the invention is a cartridge support for an ammunition cartridge having a conical forward portion and disposed in a container, the cartridge support comprising a generally cylindrical, hollow body having a longitudinal axis; an interior surface of the hollow body defined by a first conical surface and a second conical surface, an angle between the first conical surface and the longitudinal axis being substantially equal to an angle between the conical forward portion of the ammunition cartridge and the longitudinal axis; the second conical surface increasing in diameter in a direction away from the first conical surface and extending to a forward end of the cartridge support; an exterior surface of the cartridge support including a flange at a rear end thereof, a third conical surface that increases in diameter from a base of the flange toward the forward end of the support, and a reduced diameter cylindrical surface that extends from an end of the third conical surface to the forward end of the support; and a plurality of longitudinal ribs formed on the third conical surface.

A second feature of the invention is a container for an ammunition cartridge having a conical forward portion, comprising a cap; a main body; a latch assembly disposed in part on the cap and in part on the main body to lock the cap and the main body in position; and a cartridge support disposed inside the main body, the cartridge support comprising: a generally cylindrical, hollow body having a longitudinal axis; an interior surface of the hollow body defined by a first conical surface and a second conical surface, an angle between the first conical surface and the longitudinal axis being substantially equal to an angle between the conical forward portion of the ammunition cartridge and the longitudinal axis; the second conical surface increasing in diameter in a direction away from the first conical surface and extending to a forward end of the cartridge support; an exterior surface of the cartridge support including a flange at a rear end thereof, a third conical surface that increases in diameter from a base of the flange toward the forward end of the support, and a reduced diameter cylindrical surface that extends from an end of the third conical surface to the forward end of the support; and a plurality of longitudinal ribs formed on the third conical surface.

A third feature of the invention is a container for an ammunition cartridge, comprising a generally cylindrical cap having a closed end and an open end, an interior of the cap having a small diameter surface and a large diameter surface, an intersection of the small diameter surface and the large diameter surface creating a step adjacent the open end, the step including a notch formed therein that extends circumferentially around the step; a generally cylindrical main body having a closed end, an open end and a wall, a thickness of the wall at the open end decreasing from a larger thickness to a smaller thickness to form a taper on an exterior surface of the wall; a latch assembly disposed in part on the cap and in part on the main body to lock the cap and the main body in position; a first gasket disposed in the notch; and a second gasket disposed around the taper of the main body; wherein when the cap is latched to the main body by the latch assembly the first and second gaskets contact each other to form a sealing surface.

A fourth feature of the invention is a container, comprising a main body; a pair of bosses disposed on the main body and axially separated, the bosses including a vertical channel and a horizontal channel, the vertical channel intersecting the horizontal channel; a strap comprising a middle portion and two end portions, the middle portion being thinner than the two end portions, the middle portion being disposed between the bosses and in the horizontal channel in each boss, the end portions being disposed on opposite sides of the bosses from the middle portion, a thickness of the end portions being greater than a thickness of the horizontal channel whereby when a load is applied to the middle portion the end portions are forced against the bosses.

A fifth feature of the invention is a container for an ammunition cartridge having a conical forward portion, comprising a cap; a main body; a latch assembly disposed in part on the cap and in part on the main body to lock the cap and the main body in position; a cartridge support disposed inside the main body, the cartridge support comprising: a generally cylindrical, hollow body having a longitudinal axis; an interior surface of the hollow body defined by a first conical surface and a second conical surface, an angle between the first conical surface and the longitudinal axis being substantially equal to an angle between the conical forward portion of the ammunition cartridge and the longitudinal axis; the second conical surface increasing in diameter in a direction away from the first conical surface and extending to a forward end of the cartridge support; an exterior surface of the cartridge support including a flange at a rear end thereof, a third conical surface that increases in diameter from a base of the flange toward the forward end of the support, and a reduced diameter cylindrical surface that extends from an end of the third conical surface to the forward end of the support; and a plurality of longitudinal ribs formed on the third conical surface; a pair of bosses disposed on the main body and axially separated, the bosses including a vertical channel and a horizontal channel, the vertical channel intersecting the horizontal channel; and a strap comprising a middle portion and two end portions, the middle portion being thinner than the two end portions, the middle portion being disposed between the bosses and in the horizontal channel in each boss, the end portions being disposed on opposite sides of the bosses from the middle portion, a thickness of the end portions being greater than a thickness of the horizontal channel whereby when a load is applied to the middle portion the end portions are forced against the bosses.

A sixth feature of the invention is a container for an ammunition cartridge, comprising a generally cylindrical cap having a closed end and an open end, an interior of the cap having a small diameter surface and a large diameter surface, an intersection of the small diameter surface and the large diameter surface creating a step adjacent the open end, the step including a notch formed therein that extends circumferentially around the step; a generally cylindrical main body having a closed end, an open end and a wall, a thickness of the wall at the open end decreasing from a larger thickness to a smaller thickness to form a taper on an exterior surface of the wall; a latch assembly disposed in part on the cap and in part on the main body to lock the cap and the main body in position; a first gasket disposed in the notch; a second gasket disposed around the taper of the main body; wherein when the cap is latched to the main body by the latch assembly the first and second gaskets contact each other to form a sealing surface; a pair of bosses disposed on the main body and axially separated, the bosses including a vertical channel and a horizontal channel, the vertical channel intersecting the horizontal channel; and a strap comprising a middle portion and two end portions, the middle portion being thinner than the two end portions, the middle portion being disposed between the bosses and in the horizontal channel in each boss, the end portions being disposed on opposite sides of the bosses from the middle portion, a thickness of the end portions being greater than a thickness of the horizontal channel whereby when a load is applied to the middle portion the end portions are forced against the bosses.

A seventh feature of the invention is a container for an ammunition cartridge having a conical forward portion, comprising a generally cylindrical cap having a closed end and an open end, an interior of the cap having a small diameter surface and a large diameter surface, an intersection of the small diameter surface and the large diameter surface creating a step adjacent the open end, the step including a notch formed therein that extends circumferentially around the step; a generally cylindrical main body having a closed end, an open end and a wall, a thickness of the wall at the open end decreasing from a larger thickness to a smaller thickness to form a taper on an exterior surface of the wall; a latch assembly disposed in part on the cap and in part on the main body to lock the cap and the main body in position; a first gasket disposed in the notch; a second gasket disposed around the taper of the main body; wherein when the cap is latched to the main body by the latch assembly the first and second gaskets contact each other to form a sealing surface; a cartridge support disposed inside the main body, the cartridge support comprising: a generally cylindrical, hollow body having a longitudinal axis; an interior surface of the hollow body defined by a first conical surface and a second conical surface, an angle between the first conical surface and the longitudinal axis being substantially equal to an angle between the conical forward portion of the ammunition cartridge and the longitudinal axis; the second conical surface increasing in diameter in a direction away from the first conical surface and extending to a forward end of the cartridge support; an exterior surface of the cartridge support including a flange at a rear end thereof, a third conical surface that increases in diameter from a base of the flange toward the forward end of the support, and a reduced diameter cylindrical surface that extends from an end of the third conical surface to the forward end of the support; and a plurality of longitudinal ribs formed on the third conical surface; a pair of bosses disposed on the main body and axially separated, the bosses including a vertical channel and a horizontal channel, the vertical channel intersecting the horizontal channel; and a strap comprising a middle portion and two end portions, the middle portion being thinner than the two end portions, the middle portion being disposed between the bosses and in the horizontal channel in each boss, the end portions being disposed on opposite sides of the bosses from the middle portion, a thickness of the end portions being greater than a thickness of the horizontal channel whereby when a load is applied to the middle portion the end portions are forced against the bosses.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

Details of the prior MONOPAQ™ container are found in U.S. Pat. No. 6,772,877. The present invention includes several changes to the prior MONOPAQ™ container. The known container includes a cartridge support disposed inside the container, for supporting the forward or fuze end of a cartridge. In the present invention, a novel cartridge support is lighter and stronger. The known container uses a conventional gasket to seal the cap of the container to the body. The present invention uses a novel configuration of the mating surfaces of the cap and body and two gaskets, one in the cap and one in the body, to seal the cap to the body. Further, the present invention includes an innovative, lightweight collapsible carrying handle.

Figure 1A:
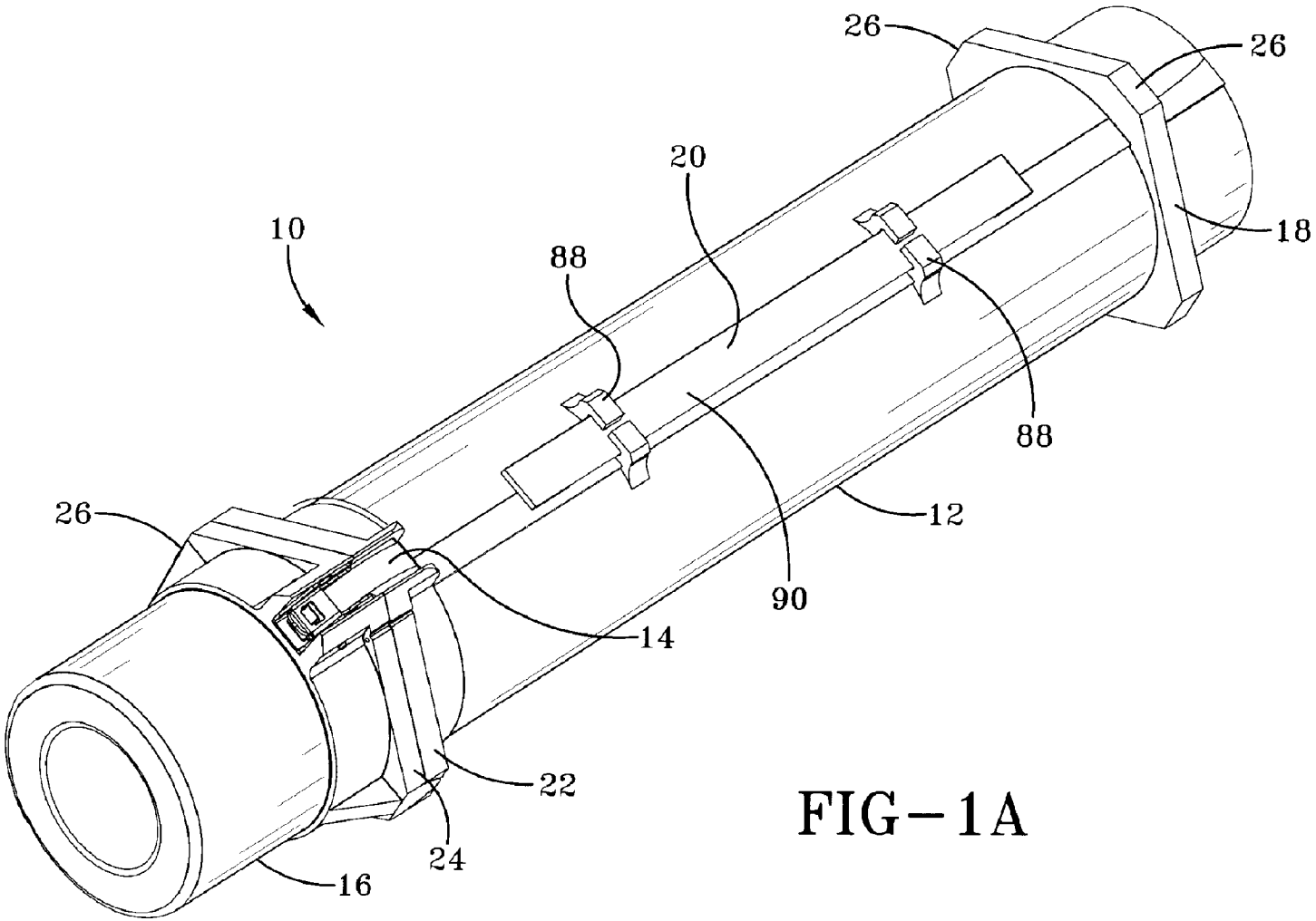
FIG. 1A is a perspective view of a MONOPAQ™ container for use as the primary packaging of a mortar round.
Figure 1B:
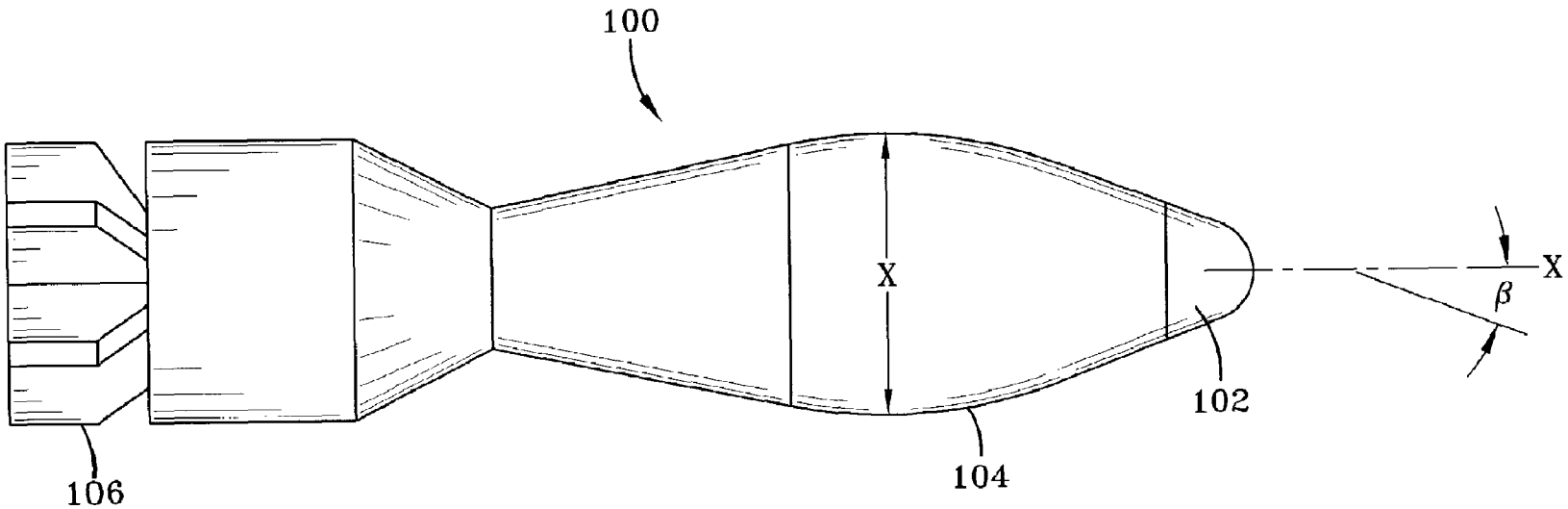
FIG. 1B is a side view of an exemplary mortar round stored in the MONOPAQ™ container of FIG. 1A.

FIG. 1A is a perspective view of a MONOPAQ™ container 10 for use as the primary packaging of a mortar cartridge (FIG. 1B). The container 10 is generally comprised of a cap 16 and a main body 12. The cap 16 and main body 12 have a generally cylindrical shape, augmented by a plurality of stacking indices 18, 22, 24. One stacking index 18 is located on the fuze or front end of body 12. Stacking index 22 is located on the rear end of body 12 and stacking index 24 is located on cap 16. When container 10 is assembled as shown in FIG. 1, stacking indices 22 and 24 join to form a single, double wide stacking index. Stacking indices 22, 24, 18 are generally rectangular in shape, with beveled corners 26. A latch assembly 14 disposed in part on the cap 16 and in part on the body 12 secures the cap 16 to the body 12.

FIG. 1B is a side view of an exemplary high explosive mortar cartridge 100 that is stored in the MONOPAQ™ container 10 of FIG. 1A. Cartridge 100 comprises a fuze section 102 at a front portion, a body section 104 and a fin section 106 at a rear portion. The area of maximum diameter of the body section 104 is indicated by x in FIG. 1B. This diameter is the Borlette diameter. The cartridge 100 is loaded into container 10 with the fuze section 102 located at the end of the container having stacking index 18 and the fin section 106 located in the cap 16 end.

Figure 2A:
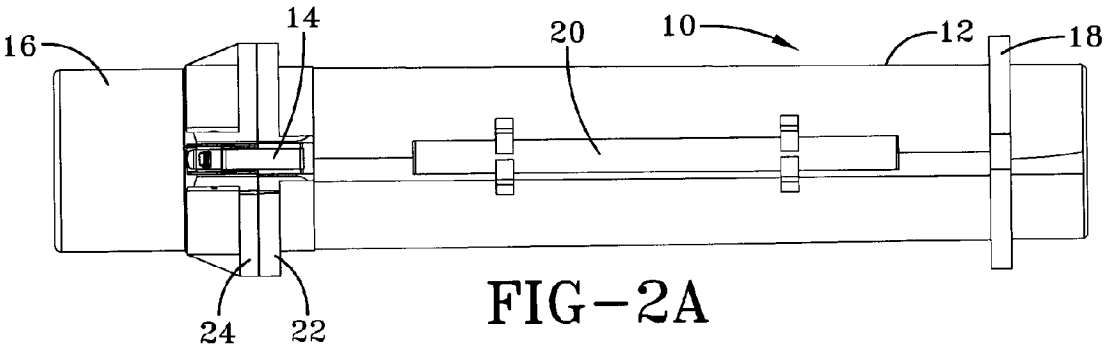
FIG. 2A is a top view of the container of FIG. 1A.
Figure 2C:
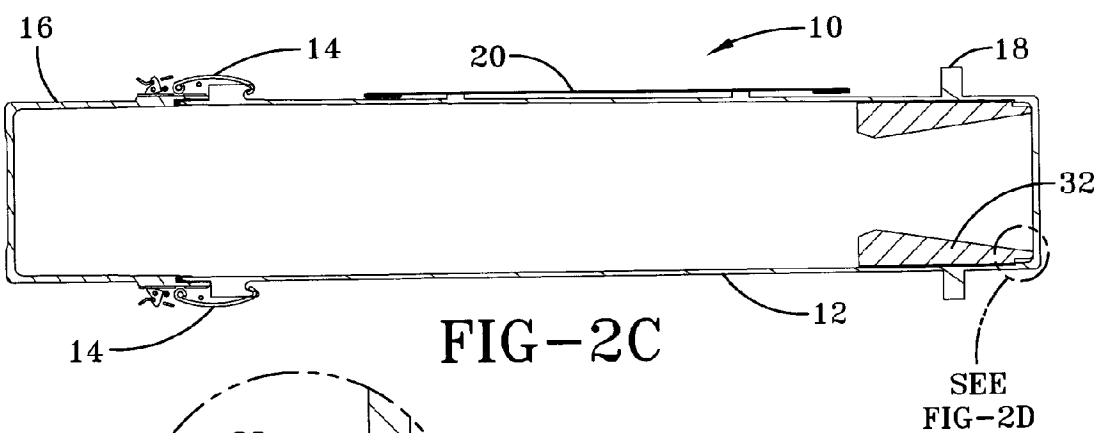
FIG. 2C is a sectional view taken along the line 2C-2C of FIG. 2B.
Figure 2D:
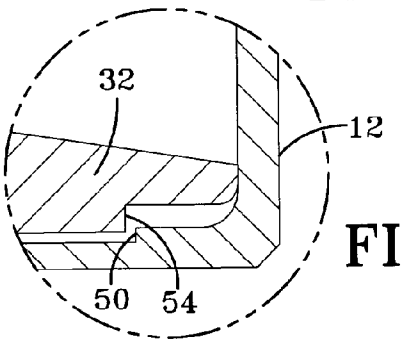
FIG. 2D is an enlarged view of a portion of FIG. 2C.
Figure 2B:
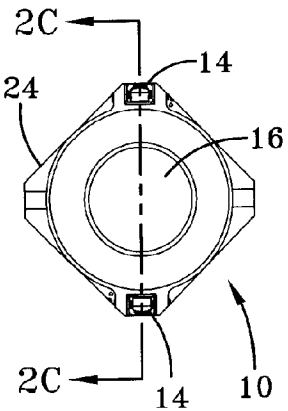
FIG. 2B is an end view of FIG. 2A.

FIG. 2A is a top view of the container 10 of FIG. 1A. FIG. 2B is an end view of FIG. 2A. FIG. 2C is a sectional view taken along the line 2C-2C of FIG. 2B. FIG. 2D is an enlarged view of a portion of FIG. 2C. As shown in FIG. 2C, a cartridge support 32 is disposed in the container 10. The cartridge support (or fuze support) 32 protects and supports the fuze section 102 of a cartridge 100, providing cushioning from exterior forces. One aspect of the present invention is an improved, lighter weight cartridge support 32.

Figure 4:
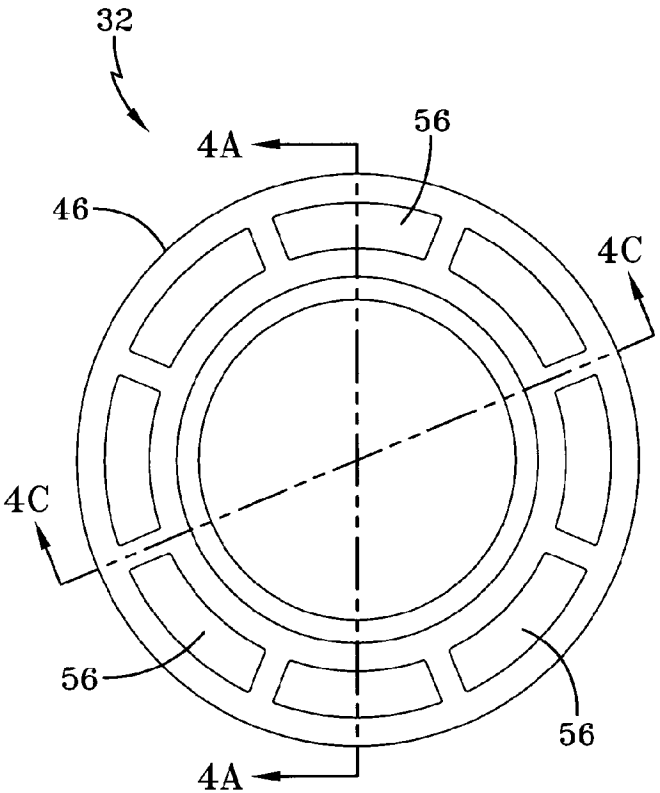
FIG. 4 is a top view of the cartridge support of FIG. 3.
Figure 3:
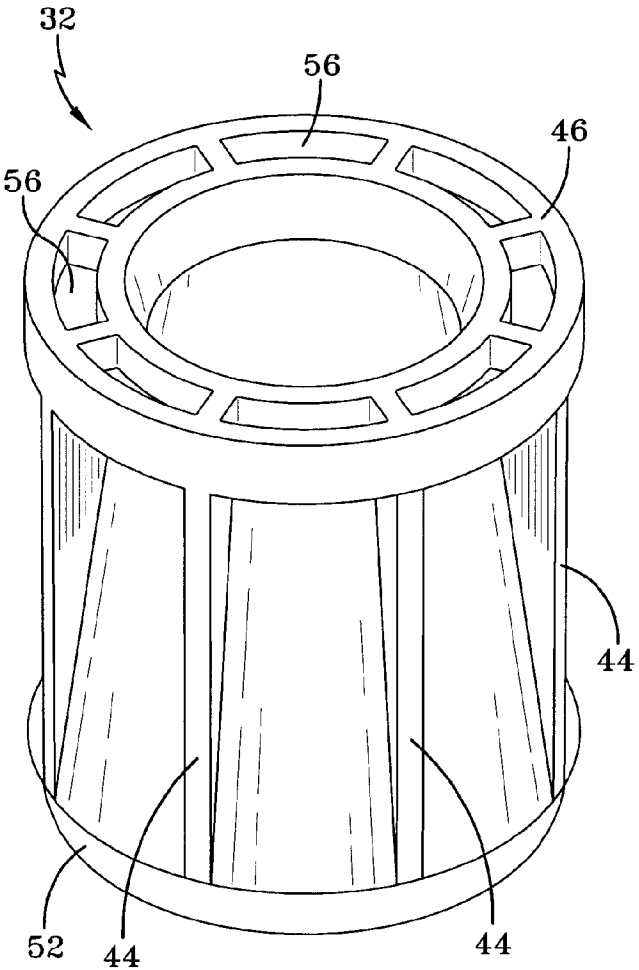
FIG. 3 is a perspective view of one embodiment of a cartridge support according to the invention.
Figure 4B:
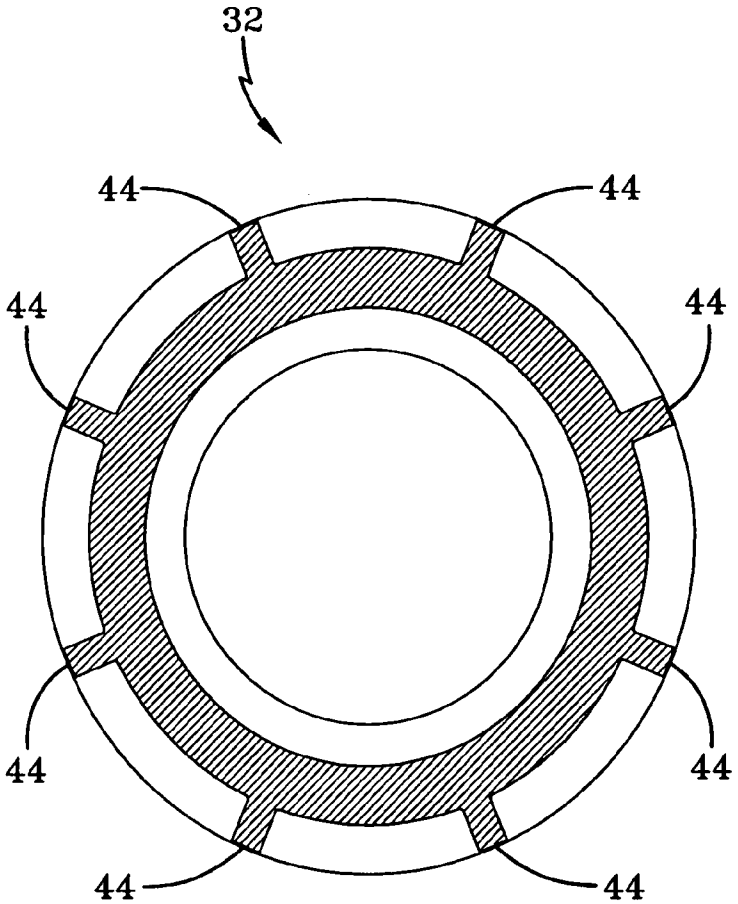
FIG. 4B is a sectional view taken along the line 4B-4B of FIG. 4A.
Figure 4A:
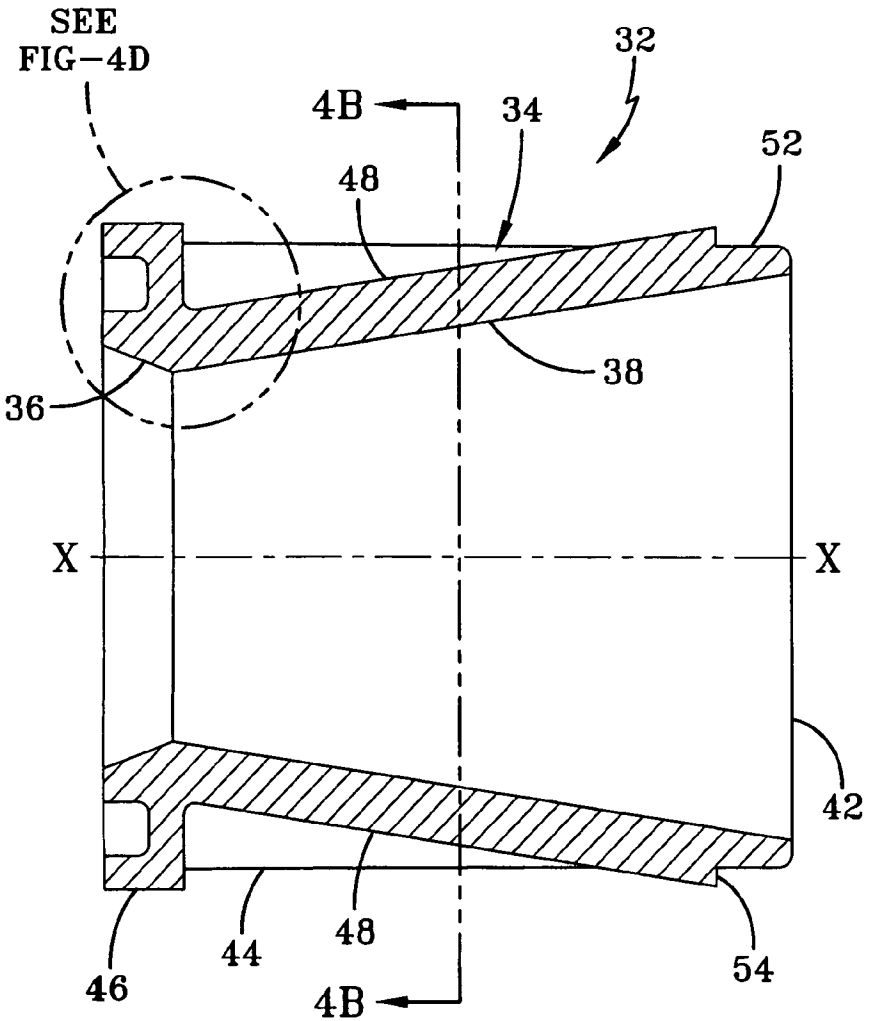
FIG. 4A is a sectional view taken along the line 4A-4A of FIG. 4.
Figure 4D:
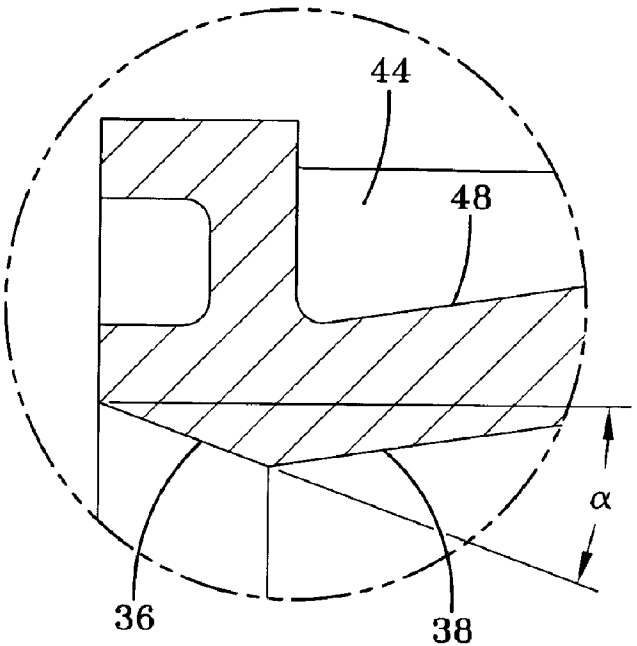
FIG. 4D is an enlarged view of a portion of FIG. 4A.
Figure 4C:
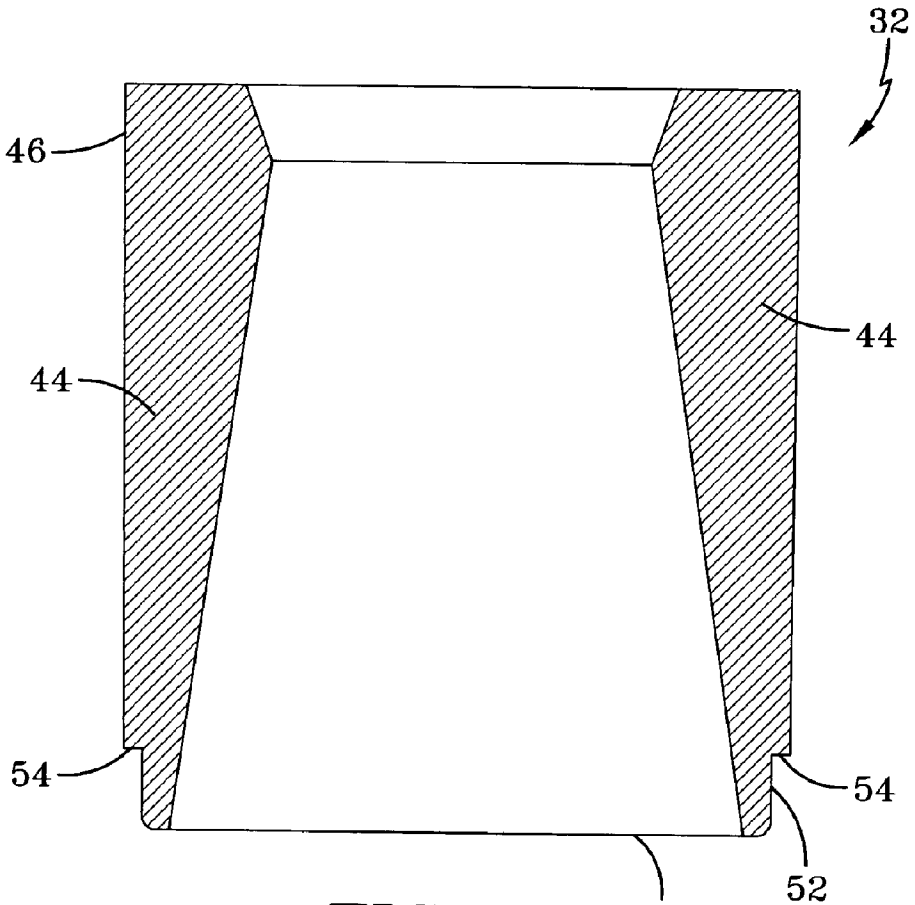
FIG. 4C is a sectional view taken along the line 4C-4C of FIG. 4.

FIG. 3 is a perspective view of one embodiment of a cartridge support 32 according to the invention. FIG. 4 is a top view of the cartridge support 32 of FIG. 3. FIG. 4A is a sectional view taken along the line 4A-4A of FIG. 4. FIG. 4B is a sectional view taken along the line 4B-4B of FIG. 4A. FIG. 4C is a sectional view of taken along the line 4C-4C of FIG. 4. FIG. 4D is an enlarged view of a portion of FIG. 4A. As shown in FIGS. 3-4, cartridge support 32 includes a generally cylindrical, hollow body 34 having a longitudinal axis X-X. The interior surface of the hollow body 34 is defined by a first conical surface 36 and a second conical surface 38. The angle alpha (FIG. 4D) between the first conical surface 36 and the longitudinal axis X-X is substantially equal to the angle beta (FIG. 1B) between the conical forward portion 102 of the ammunition cartridge 100 and the longitudinal axis X-X. The second conical surface 38 (FIG. 4A) increases in diameter in a direction away from the first conical surface 36 and extends to a forward end 42 of the cartridge support 32.

The external surface of the support 32 includes a flange 46 at a rear end of the support 32, a third conical surface 48 that increases in diameter from the base of flange 46 toward the forward end 42 of the support, and a reduced diameter cylindrical surface 52 that extends from the end of third conical surface 48 to the end 42 of the support 32. The step or notch 54 created between third conical surface 48 and reduced diameter cylindrical surface 52 mates with a corresponding notch 50 (FIG. 2D) in the MONOPAQ™ container body 12 to securely locate the support 32 in the container body 12. The tapered nature of the third conical surface 48 provides for the best possible compression and rebound of the container 10.

As shown in FIGS. 3-4, flange 46 includes a plurality of slots 56 formed on its rear surface. The slots 56 help reduce the amount of material used and the weight of support 32 and, consequently, the weight of container 10. Preferably, the slots 56 are circumferentially evenly spaced. In one preferred embodiment, the number of slots is eight.

A plurality of longitudinal ribs 44 are formed on the conical surface 48. Each rib 44 extends from the forward face of the flange 46 to the end of conical surface 48. As seen in FIG. 4C, the radial width of each rib 44 is largest where the rib abuts flange 46 and decreases as the diameter of conical surface 48 increases, until the rib completely blends with conical surface 48 where notch 54 is formed. As best seen in FIGS. 4A and 4B, the outermost radial extent of each rib 44 is constant along the longitudinal length of the support 32 and does not exceed the outside diameter of the flange 46. Preferably, the ribs 44 are circumferentially evenly spaced. In one preferred embodiment, the number of ribs is eight.

The use of ribs 44 decreases the overall weight of support 32 and spreads the dynamic load distribution over a larger amount of material. The longitudinal ribs 44 significantly increase the strength of the support 32 in the longitudinal direction. This increased strength helps avoid cracking (which is a common failure for thermoplastics) of the support 32 during rough handling impacts of the container 10. Flange 46 also increases the strength of the support 32 in both the radial and longitudinal directions. The flange 46 substantially increases the hoop strength of the support 32 in the radial direction and prevents the interior opening of support 32 from being forcibly enlarged upon a nose down impact. An enlarged support opening would allow the cartridge 100 to penetrate through the support 32 and hit the bottom of the container 10. As a result, the cartridge 100 would likely receive unrecoverable damages. The ribs 44 and flange 46 are important in preventing such an enlargement of the interior opening of support 32.

A preferred composition of the support 32 is high-density polyethylene (HDPE). The support 32 satisfies packaging performance requirements from ambient to temperature extremes (−60° F. and +160° F.). The MONOPAQ™ cartridge support 32 provides fuze protection, and satisfies dynamic loading and drop testing requirements. The cartridge support 32 can be adapted to other U.S. or foreign ammunition packaging which require similar internal cartridge/fuze support. The cartridge support 32 is placed in the forward end of the MONOPAQ™ container 10 before the cartridge 100 is inserted. If necessary, the support 32 can be bonded to the bottom of the container 10 to eliminate the presence of loose or moving parts. The cylindrical support 32 allows the nose end 102 of the cartridge 100 to rest on its first conical surface 36, while completely surrounding and protecting the fuze.

Another aspect of the present invention is a new sealing system for the MONOPAQ™ container. An ammunition container must have the ability to provide full environmental protection to ammunition packaged for 20 years of indoor storage and 2 years of outdoor storage. A container that holds a leak proof seal at both hot (+160° F.) and cold (−65° F.) temperature extremes helps meet this requirement. Such a seal must remain intact and retain a 3 psi seal following compression, vibrations and drops that frequently occur during storage and transportation.

The inventive sealing system includes novel mating surfaces on the body 12 and cap 16 of the MONOPAQ™ container 10 and novel gaskets for the body and cap mating surfaces. The sealing system uses the interface of two gaskets to provide a leak proof seal that meets the performance requirements for ammunition containers. The inventive gaskets are made of, for example, neoprene rubber.

Figure 5:
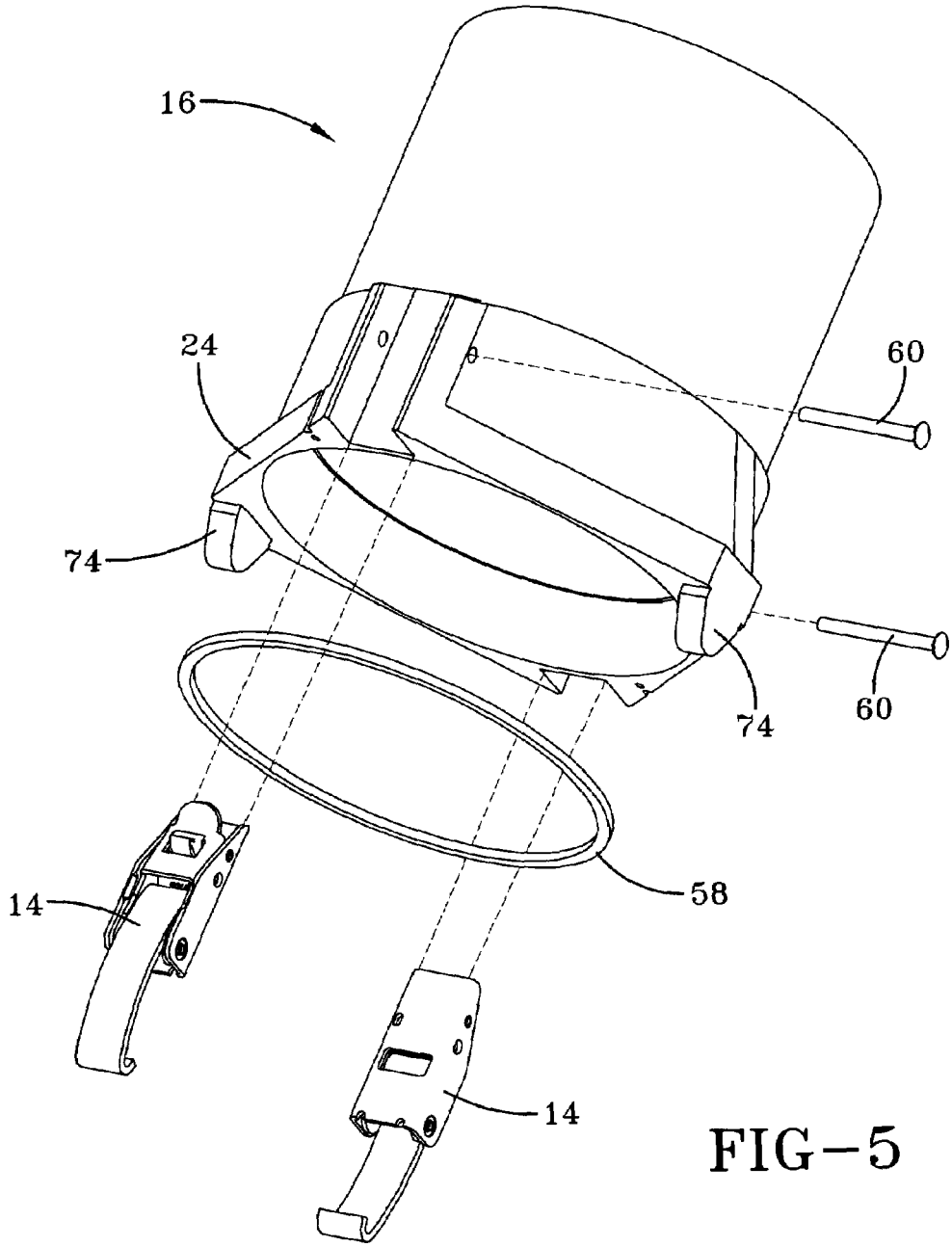
FIG. 5 is an exploded view of a cap.
Figure 5B:
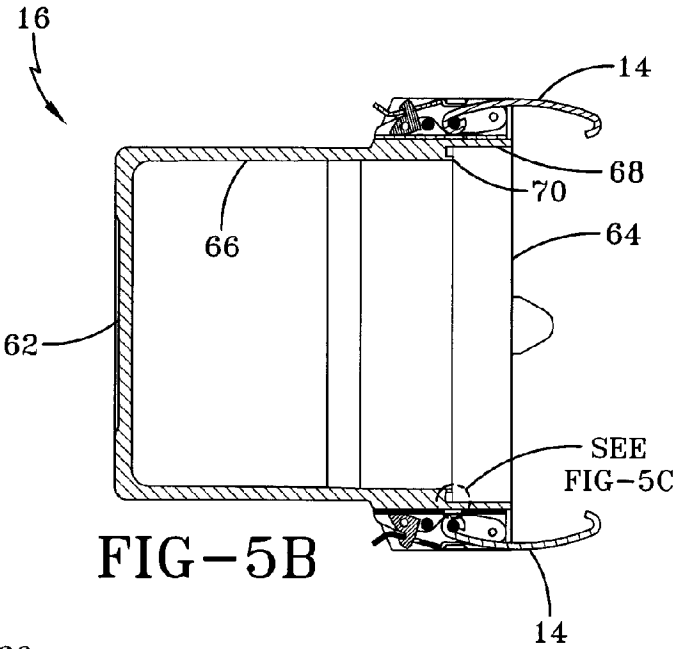
FIG. 5B is a sectional view taken along the line 5B-5B of FIG. 5A.
Figure 5A:
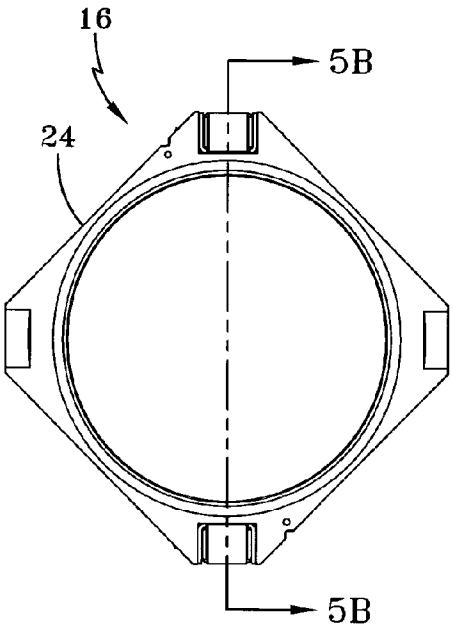
FIG. 5A is an end view of the cap of FIG. 5.
Figure 5C:
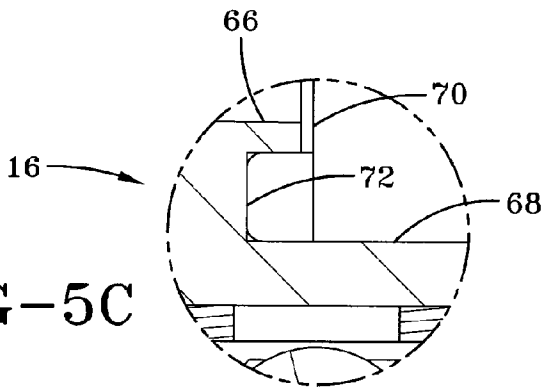
FIG. 5C is an enlarged view of a portion of FIG. 5B.

FIG. 5 is an exploded view of a cap 16. FIG. 5A is an end view of the cap 16 of FIG. 5. FIG. 5B is a sectional view taken along the line 5B-5B of FIG. 5A. FIG. 5C is an enlarged view of a portion of FIG. 5B. Cap 16 is generally cylindrical with a closed end 62 and an open end 64. Latch assemblies 14 are attached to cap 16 with pins 60. Stacking index 24 is formed adjacent open end 64. The interior of the cap 16 includes a small diameter surface 66 and a large diameter surface 68 (FIGS. 5B and 5C). The intersection of the small diameter surface 66 and the large diameter surface 68 creates a step 70 adjacent the open end 64. The step 70 includes a notch 72 formed therein that extends circumferentially around the step 70. Preferably, notch 72 has a rectangular shape.

Figures 6A, 6B, 6C:
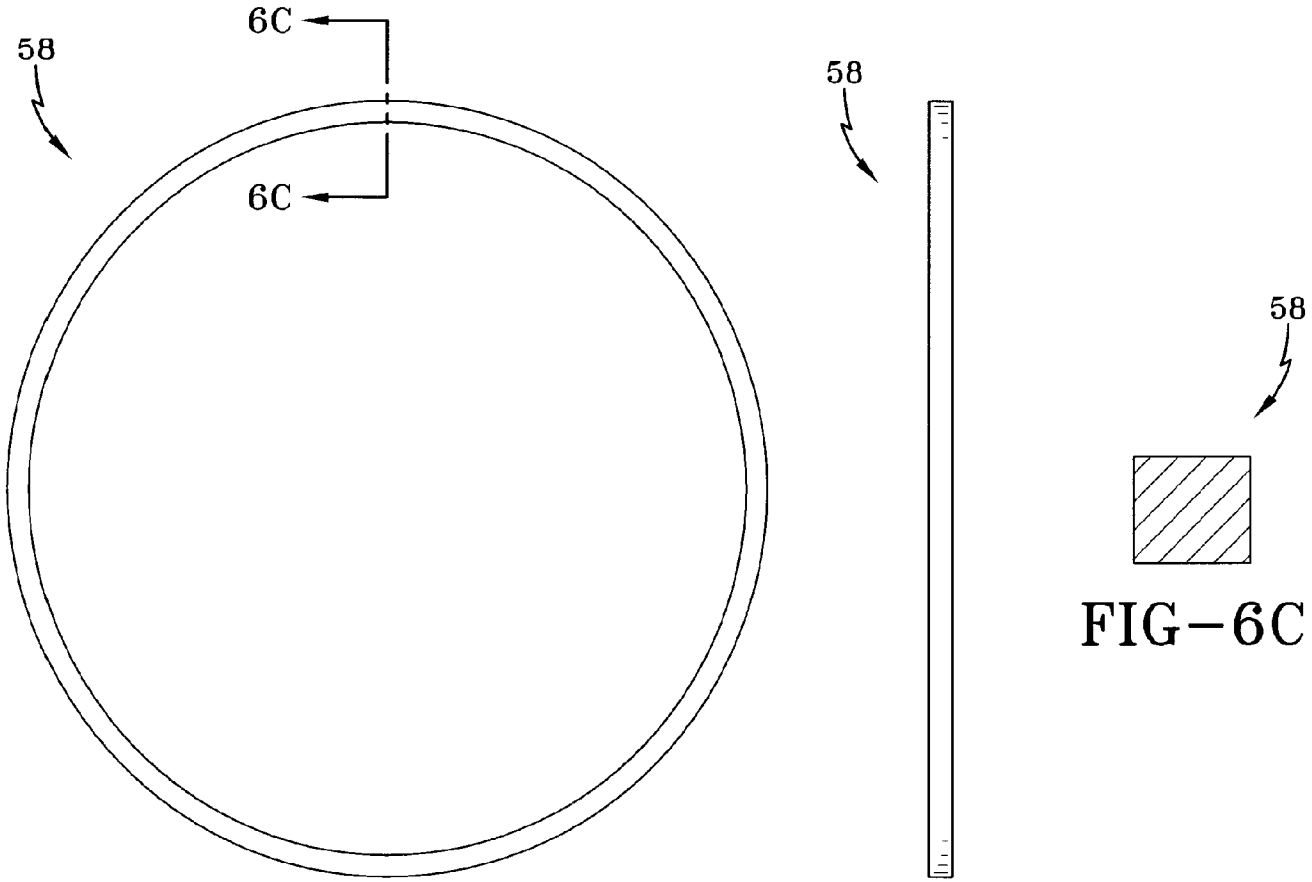
FIG. 6A is a end view of a cap gasket.
FIG. 6B is a side view of the cap gasket of FIG. 6A.
FIG. 6C is a sectional view taken along the line 6C-6C of FIG. 6A.

FIG. 6A is a end view of a cap gasket 58. FIG. 6B is a side view of the cap gasket 58 of FIG. 6A. FIG. 6C is a sectional view taken along the line 6C-6C of FIG. 6B. Cap gasket 58 is circular with a rectangular cross-section. Cap gasket 58 fits into notch 72 in cap 16. A high strength adhesive is applied to the three surfaces of notch 72 to ensure the gasket 58 does not become dislodged during opening of the container 10. Cap 16 also includes a pair of alignment features 74 (FIG. 5) formed on opposite sides of the open end 64 of cap 16. Alignment features 74 mate with corresponding alignment channels 76 (FIG. 7) on body 12. The alignment features 74 help in fitting cap 16 on body 12 and assuring precise alignment of the gasket 58 and latch assembly 14. Preferably, the alignment features 74 are generally V-shaped.

Figure 7:
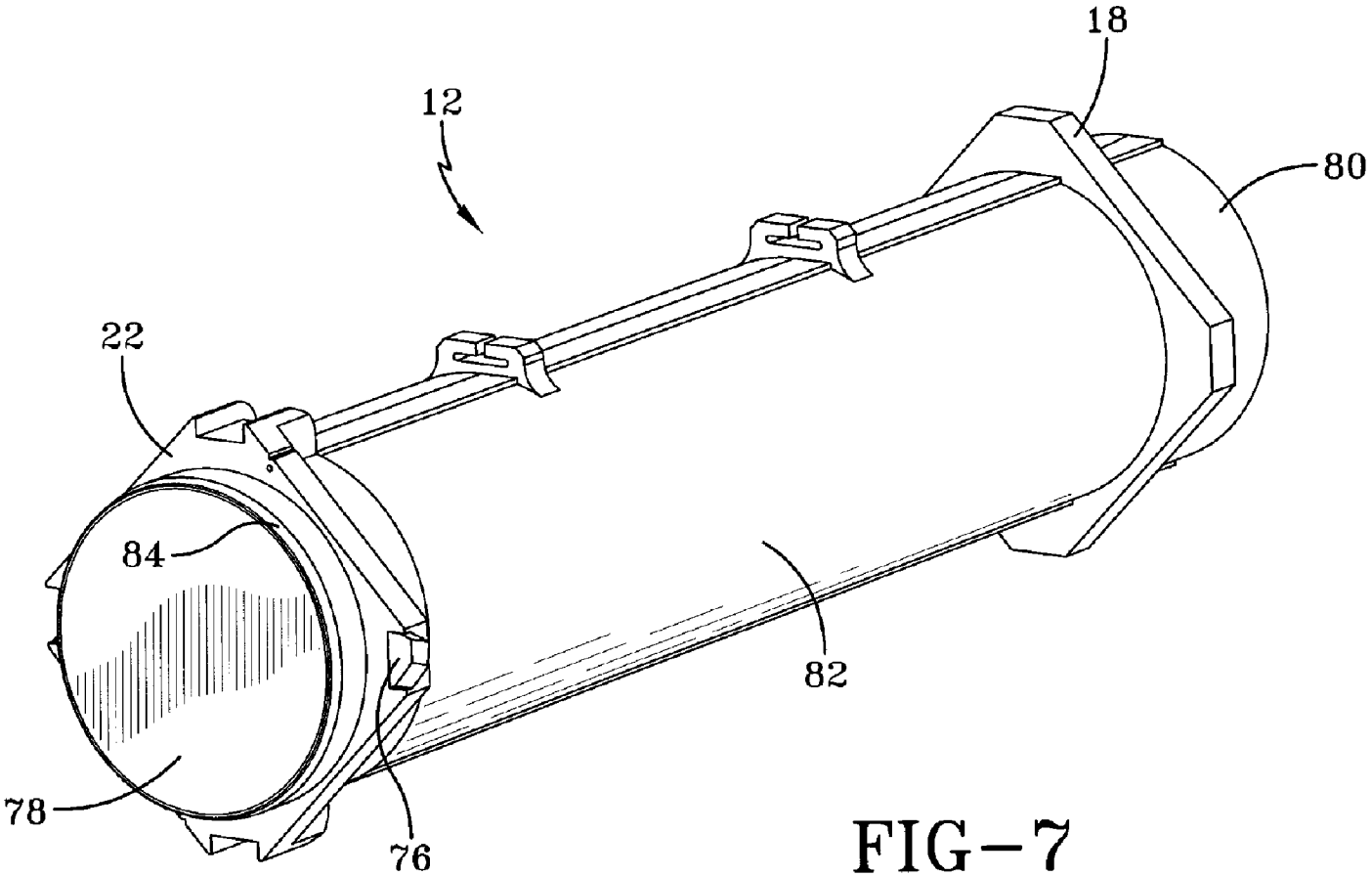
FIG. 7 is a perspective view of a container body.
Figure 7A:
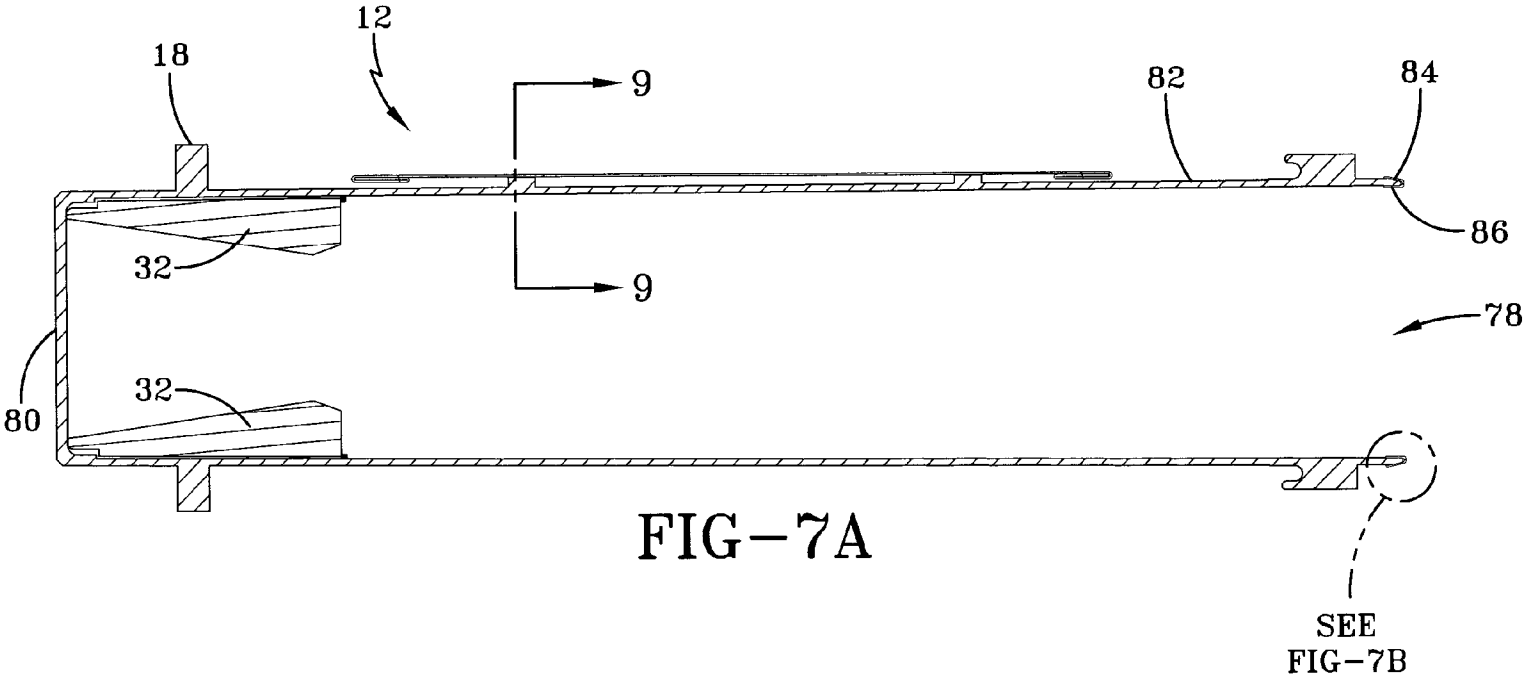
FIG. 7A is a side sectional view of a container body with carrying handle installed.
Figure 7B:
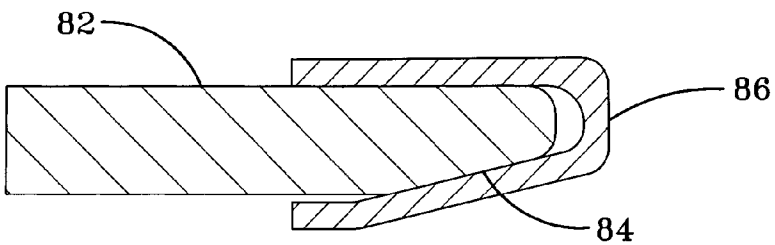
FIG. 7B is an enlarged view of a portion of FIG. 7A.
Figures 8, 8A, 8B:
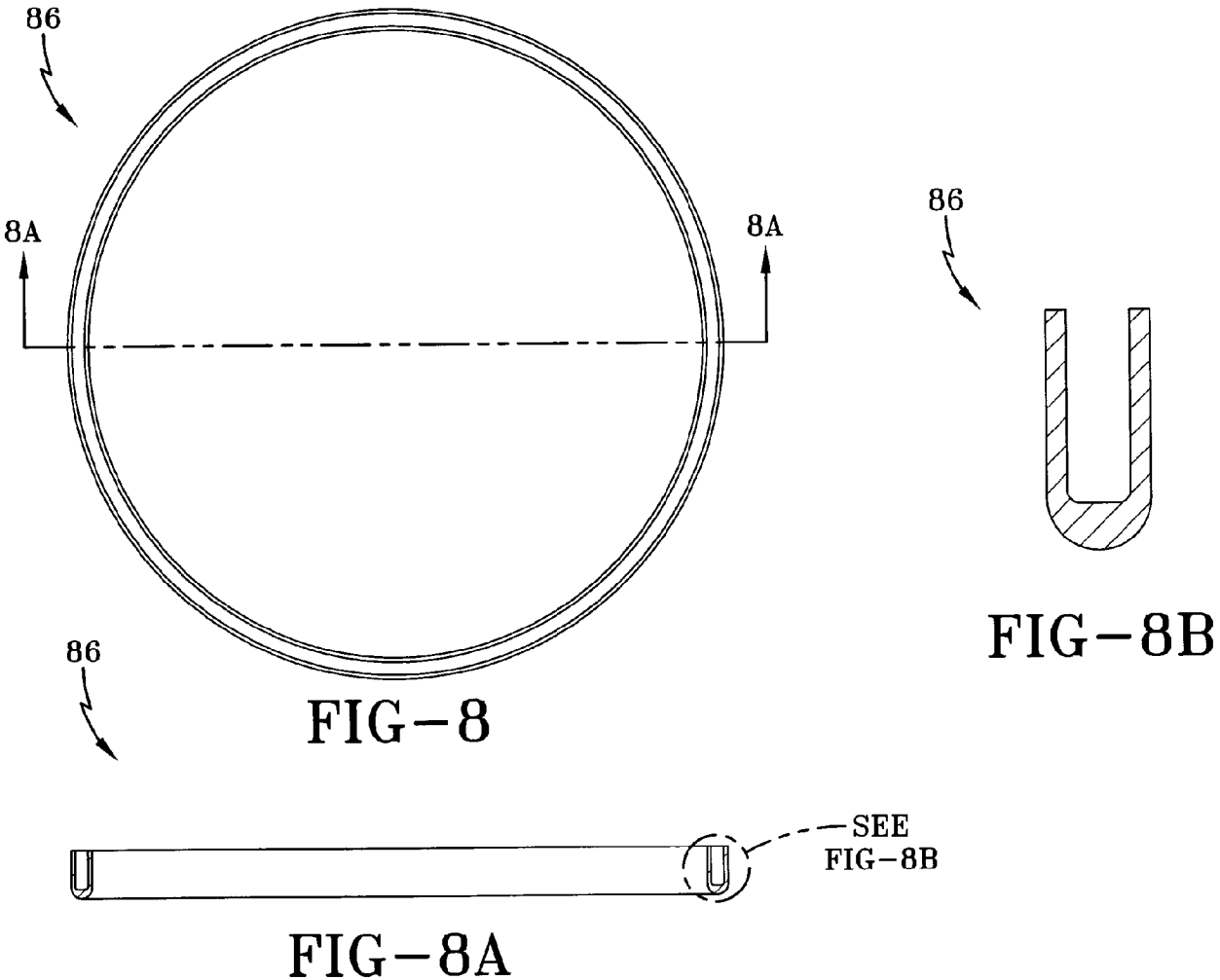
FIG. 8 is a top view of a body gasket.
FIG. 8A is a sectional view taken along the line 8A-8A of FIG. 8.
FIG. 8B is an enlarged view of a portion of FIG. 8A.

FIG. 7 is a perspective view of a container body 12. FIG. 7A is a side sectional view of the container body 12 of FIG. 7. FIG. 7B is an enlarged view of a portion of FIG. 7A. Body 12 is generally cylindrical and includes a closed end 80, an open end 78 and a wall 82. The thickness of the wall 82 at the open end 78 decreases from a larger thickness to a smaller thickness to form a taper 84 on the exterior surface of the wall 82 (FIG. 7B). A second gasket 86 is disposed at the open end 78 of the body around taper 84. As best seen in FIGS. 8A and 8B, gasket 86 has a generally U-shaped cross-section. When the cap 16 is latched to the body 12 by the latch assembly 14, the cap gasket 58 and the body gasket 86 contact each other to form a sealing surface.

Removal of the cap 16 from the body 12 is easier with the taper 84 as compared to a non-tapered body. A small gap between the taper 84 and the cap interior wall allows the U-shaped gasket 86 room to expand when compressed, which is essential for a tight seal. The U-shaped gasket 86 is neoprene molded to match the exact dimensions regarding the diameter of the body opening 78 and the tapered body end 84. High strength adhesive is applied to the taper 84 and then the gasket 86 is installed.

The contact of the two gaskets 58, 86 allows for a larger seal area than if only one gasket was used. This is because both gaskets 58, 86 are in compression, which forms a large seal area compared to the tight dimensional confines of the cap/body interface area. As well as sealing in compression, the body gasket 86 also seals with shear force on the inside of the cap 16, without compromising the forces needed to apply or remove the cap. When the container 10 is dropped or vibrated severely, the cap 16 moves in and out slightly with respect to the body 12. The use of the two gaskets 58, 86 allows for this slight displacement as a means of shock absorption, while retaining seal ability. The cap gasket 58 also acts as a cushion that provides substantial protection to avoid cuts on the body gasket 86.

The process of initially sealing the container 10 comprises three primary steps:

1. Cap gasket 58 is added to the cap 16: Cap 16 is designed to accept the rectangular cross-section of the neoprene gasket 58. The cap channel or notch 72 is coated with adhesive and the gasket 58 is then inserted. The cap notch 72 keeps the gasket 58 highly constrained even if the adhesive fails.

2. Gasket 86 is added to the body taper 84: The body taper 84 allows proper fit into the U-shaped gasket 86. As with the cap gasket 58, an adhesive is applied to keep the gasket 86 secure.

3. Assembly of cap and body: A seal is made in compression between the cap gasket 58 and the body gasket 86. The body gasket 86 also forms a shear seal with the polyester composite material that forms the inside of the cap 16. Due to the dimensional constraints on the container 10, the use of two gaskets 58, 86 allows great compression, accomplished at a level that is acceptable for latch open/close forces.

Another aspect of the invention is a carrying handle for the MONOPAQ™ container 10. The soldier requires a sturdy handle to rapidly transport the containers 10 containing ammunition in an adverse battlefield environment. This requirement is more critical when operating in a remote area where motorized transportation is not viable, as was learned in the Southwest Asia theater. The innovative, lightweight collapsible carrying handle of the present invention satisfies this requirement and solves this problem.

The inventive handle for the MONOPAQ™ container 10 is a simple and cost effective solution to handle mounting. There is no need for expensive adhesives (which usually do not maintain the required strength at both high and low temperature extremes), reinforced metal brackets, steel handle levers, mechanical fasteners, or any closure components that may require the use of secondary manufacturing operations. As shown in FIG. 1A, the handle 20 comprises two main components, bosses 88 and a strap 90. The handle bosses 88 are preferably compression molded as a single piece with the container body 12. The handle strap 90 is preferably made of woven polypropylene. The strap 90 is easily installed on the bosses 88 through a small open slot on top of the boss. The elimination of adhesive, mechanical fasteners, closure components and special tools drastically decreases the possibility of human error during the assembly operation. The design also allows for a simple, inexpensive replacement of the handle strap 90 if rework is ever required for the container in the field environment.

The handle 20 exceeds the 175 pound minimum breaking strength for pull test at +160° F. and −65° F. temperatures. The carrying handle 20 breaking strength averages over 350 pounds, based on lab test results. The handle 20 remains fully collapsible so as not to impede on the envelope requirements of the container 10. The handle strap 90 can be easily removed and replaced if, for example, the container 10 is subjected to NBC (Nuclear, Biological, Chemical) contamination. The handle 20 uses no metal parts, which is beneficial for passing the fast and slow cook-off (FCO and SCO) testing requirements as there are no hazardous metal fragments generated during the FCO and SCO scenarios. As a result, better Insensitive Munitions (IM) response is obtained. The handle strap 90 also successfully passed the sequential rough handling (drop, vibration) testing of the container 10.

Figure 9:
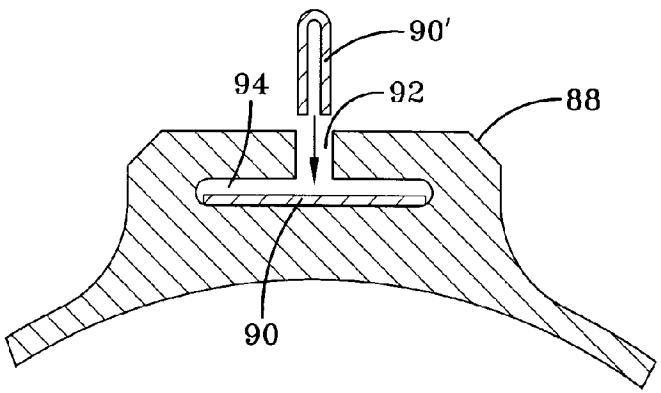
FIG. 9 is a sectional view of a handle boss taken along the line 9-9 of FIG. 7A.

FIG. 9 is a sectional view of a handle boss 88 taken along the line 9-9 of FIG. 7A. The bosses 88 are molded as solid pieces along the length of the body 12. A robot operated cutter machines a thin vertical channel 92 in the boss 88, followed by a horizontal channel 94 wherein the handle strap 90 is contained. Bosses 88 are axially separated on the body 12. The vertical channel 92 intersects the horizontal channel 94.

Figure 10A:
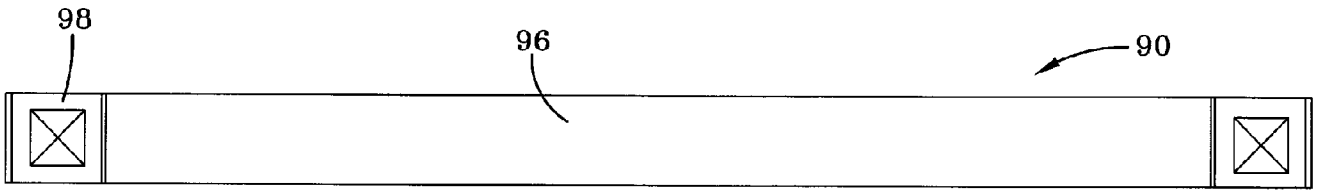
FIG. 10A is a top view of a handle strap.
Figure 10B:
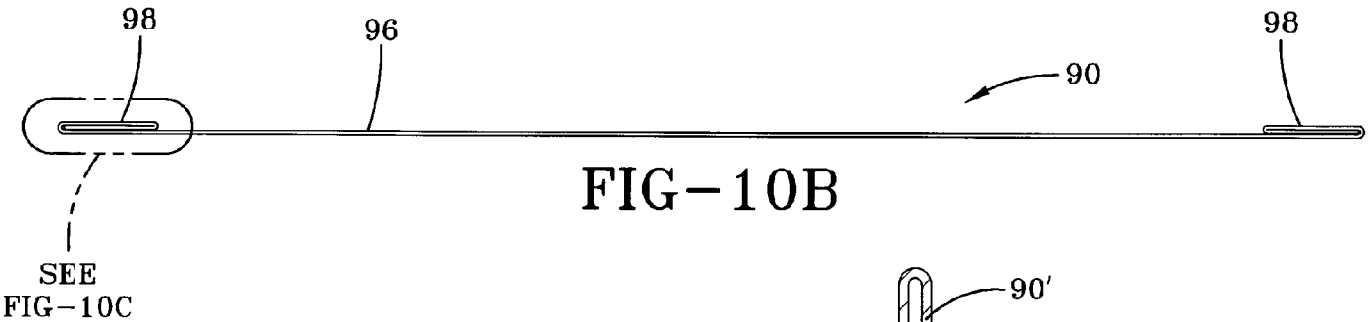
FIG. 10B is a side view of the handle strap of FIG. 10A.
Figure 10C:
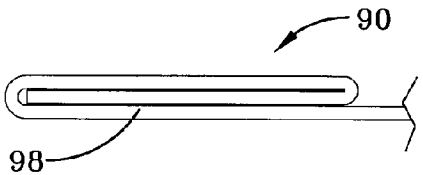
FIG. 10C is an enlarged view of a portion of FIG. 10B.

FIG. 10A is a top view of a handle strap 90. FIG. 10B is a side view of the handle strap 90 of FIG. 10A. FIG. 10C is an enlarged view of a portion of FIG. 10B. Strap 90 includes a middle portion 96 and two end portions 98. Middle portion 96 is thinner than the two end portions 98. Middle portion 96 is disposed between the bosses 88 and in the horizontal channel 94 in each boss 88. End portions 98 are disposed on opposite sides of the bosses 88 from the middle portion 96. The thickness of the end portions 98 is greater than the thickness of the horizontal channels 94 so that the end portions 98 will not be pulled through the horizontal channels 94 when a load is applied to the middle portion 96. Rather, the end portions 98 will be forced against the bosses 88. Strap 90 is made of, for example, woven polypropylene. In one embodiment, strap 90 is about 14 inches long by about one inch wide and about 0.065 inches thick in the middle portion 96. The end portions 98 are thickened by, for example, double folding and stitching. An exemplary width of the vertical channel 92 is about 0.16 inches. An exemplary thickness of the horizontal channel 94 is about 0.115 inches.

As shown in FIG. 9, the strap assembly process is as simple as tightly pinching the handle strap in half (as shown by 90' in FIG. 9) and inserting the strap 90 into the vertical channel 92. The strap 90 naturally opens up into the horizontal channel 94. Strap 90 remains completely collapsible in the horizontal channels 94. Pull testing has shown that the composite handle bosses 88 will fail at maximum weight before the strap 90 can be pulled out of the mounting boss 88.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A container for an ammunition cartridge having a conical forward portion, comprising:

a cap;

a main body;

a latch assembly disposed in part on the cap and in part on the main body to lock the cap and the main body in position; and a cartridge support disposed inside the main body, the cartridge support comprising:

a generally cylindrical, hollow body having a longitudinal axis;

an interior surface of the hollow body defined by a first conical surface and a second conical surface, an angle between the first conical surface and the longitudinal axis being substantially equal to an angle between the conical forward portion of the ammunition cartridge and the longitudinal axis; the second conical surface increasing in diameter in a direction away from the first conical surface and extending to a forward end of the cartridge support;

an exterior surface of the cartridge support including a flange at a rear end thereof, a third conical surface that increases in diameter from a base of the flange toward the forward end of the support, and a reduced diameter cylindrical surface that extends from an end of the third conical surface to the forward end of the support; wherein the flange includes a plurality of slots formed on a rear surface thereof; and a plurality of longitudinal ribs formed on the third conical surface.

2. A container for an ammunition cartridge having a conical forward portion, comprising:

a cap;

a main body;

a latch assembly disposed in part on the cap and in part on the main body to lock the cap and the main body in position; and a cartridge support disposed inside the main body, the cartridge support comprising:

a generally cylindrical, hollow body having a longitudinal axis;

an interior surface of the hollow body defined by a first conical surface and a second conical surface, an angle between the first conical surface and the longitudinal axis being substantially equal to an angle between the conical forward portion of the ammunition cartridge and the longitudinal axis; the second conical surface increasing in diameter in a direction away from the first conical surface and extending to a forward end of the cartridge support;

an exterior surface of the cartridge support including a flange at a rear end thereof, a third conical surface that increases in diameter from a base of the flange toward the forward end of the support, and a reduced diameter cylindrical surface that extends from an end of the third conical surface to the forward end of the support; and a plurality of longitudinal ribs formed on the third conical surface; wherein each longitudinal rib extends from a forward face of the flange to an end of the third conical surface.

3. A cartridge support for an ammunition cartridge having a conical forward portion and disposed in a container, the cartridge support comprising: a generally cylindrical, hollow body having a longitudinal axis: an interior surface of the hollow body defined by a first conical surface and a second conical surface, an angle between the first conical surface and the longitudinal axis being substantially equal to an angle between the conical forward portion of the ammunition cartridge and the longitudinal axis; the second conical surface increasing in diameter in a direction away from the first conical surface and extending to a forward end of the cartridge support; an exterior surface of the cartridge support supporting a flange at a rear end thereof, a third conical surface that increases in diameter from a base of the flange toward the forward end of the support, and a reduced diameter cylindrical surface that extends from an end of the third conical surface to the forward end of the support; wherein the flange includes a plurality of slots formed on a rear surface thereof; and a plurality of longitudinal ribs formed on the third conical surface.

4. A cartridge support for an ammunition cartridge having a conical forward portion and disposed in a container, the cartridge support comprising: a generally cylindrical, hollow body having a longitudinal axis; an interior surface of the hollow body defined by a first conical surface and a second conical surface, an angle between the first conical surface and the longitudinal axis being substantially equal to an angle between the conical forward portion of the ammunition cartridge and the longitudinal axis; the second conical surface increasing in diameter in a direction away from the first conical surface and extending to a forward end of the cartridge support; an exterior surface of the cartridge support supporting a flange at a rear end thereof, a third conical surface that increases in diameter from a base of the flange toward the forward end of the support, and a reduced diameter cylindrical surface that extends from an end of the third conical surface to the forward end of the support; and a plurality of longitudinal ribs formed on the third conical surface, wherein each longitudinal rib extends from a forward face of the flange to an end of the third conical surface.

* * * * *